United States Patent [19]

Igari et al.

[11] Patent Number: 5,073,302

[45] Date of Patent: Dec. 17, 1991

[54] VARISTOR MATERIAL AND PROCESS FOR PRODUCTION THEREFOR

[75] Inventors: Akihide Igari, Tokyo; Zenbee Nakagawa, Kanagawa, both of Japan

[73] Assignee: Somar Corporation, Tokyo, Japan

[21] Appl. No.: 365,884

[22] Filed: Jun. 14, 1989

[51] Int. Cl.[5] ..... H01B 1/06

[52] U.S. Cl. ..... 252/518; 264/61; 264/66; 264/65; 264/104; 264/235; 29/610.1; 419/19; 419/48; 419/49; 419/53

[58] Field of Search ..... 252/518; 264/61, 60, 264/66, 65, 235, 104; 29/610.1, 619; 419/19, 48, 49, 53

[56] References Cited

U.S. PATENT DOCUMENTS 3,886,097 5/1975 Hossenlopp ..... 255/518 X 4,180,483 12/1979 Ho et al. ..... 252/58

FOREIGN PATENT DOCUMENTS 2651274 5/1977 European Pat. Off. .

*Primary Examiner*—Josephine Barr

*Attorney, Agent, or Firm*—Sughrue, Mion, Zinn, Macpeak & Seas

[57] ABSTRACT

A varistor material comprising two crystalline phases of ZnO and $ZnMn_2O_4$, wherein Zn and Mn are present at such a ratio that 3 to 7% by mol of ZnO is contained per 100% by mol of ZnO+MnO and the nonlinear index ($\alpha$) of the varistor properties is at least 10; and a process for the production of the same, which comprises adding a manganese compound to ZnO at such a ratio as to give a content of MnO, sintering the mixture at 1100° to 1350° C., and further annealing the obtained sintered material at a temperature lower than the sintering temperature by at least 50° C. and higher than 1000° C. are disclosed.

2 Claims, No Drawings

VARISTOR MATERIAL AND PROCESS FOR PRODUCTION THEREFOR

FIELD OF THE INVENTION

This invention relates to a zinc oxide varistor material comprising zinc oxide as a base as well as a process for the production thereof.

BACKGROUND OF THE INVENTION

It is widely known that the electric resistance of a sintered zinc oxide containing a specific additive would considerably vary depending on electric voltage. Such a material has widely been applied to the stabilization of electric voltage or to the absorption of surge voltage by taking advantage of the nonlinear relationship between its voltage and current. These electric nonlinear elements are called varistors.

The quantative relationship between the electric current and voltage of a varistor is approximately represented by the following equation (1).

$$I=(V/C)^{\alpha} \quad (1)$$

wherein V represents an electric voltage applied to the varistor; I represents an electric current passing therethrough; C is a constant; and $\alpha$ is an index larger than 1.

In this case, $\alpha$ is called a nonlinear index which indicates the degree of the nonlinearity. Generally speaking, the larger o value is the more preferable. $\alpha$ is calculated according to the following equation (2).

$$\alpha=\log_{10}(I_2/I_1)/\log_{10}(V_2/V_1) \quad (2)$$

wherein $V_1$ and $V_2$ each represent the electric voltage at given current $I_1$ and $I_2$.

In a common case, $I_1$ and $I_2$ are determined at 1 mA and 10 mA, respectively and $V_1$ is called the varistor voltage. C and $\alpha$ vary depending on the formulation and production method of the varistor. These facts have been already well known in the art.

A zinc oxide varistor may be usually produced by the following method.

Namely, additives are mixed with zinc oxide. The obtained mixture is molded into a desired shape by a common molding method employed for ceramics and subsequently sintered at an appropriate temperature. During this sintering stage, required reactions would occur among the zinc oxide and additives. Thus, the mixture is molten and sintered to thereby give the aimed varistor material. Subsequently the obtained varistor material is provided with electrodes and a conductor. Thus an element is formed.

Although several theories have been reported relating to the mechanisms of the expression of the varistor properties of sintered zinc oxide materials, no definite one has been established so far. However it is recognized that the electric properties of a varistor originate from its microstructure. A zinc oxide varistor generally comprises zinc oxide particles around which a highly resistant boundary layer is located and bound thereto. Additives are employed in order to form this boundary layer. Several or more additives are generally used and the types and amounts thereof may vary depending on the aimed properties.

Conventional methods for the production of a zinc oxide varistor material suffer from a serious problem. That is to say, the properties of a sintered material would widely vary, which makes it impossible to efficiently produce varistor materials of constant properties. This problem might be caused by the fact that it is difficult to uniformly control the microstructure and microdistribution of chemical components of the sintered varistor material at a high reproducibility. In the prior art, there are a number of additives to be used and these additives complicatedly and delicately react with zinc oxide as well as with each other upon firing. Therefore these reactions are considerably affected by a change in the production conditions.

Furthermore, additives which are liable to be evaporated at a high temperature such as bismuth oxide are frequently employed in the prior art, which makes the control of the microstructure of the sintered material and microdistribution of chemical components thereof more difficult.

SUMMARY OF THE INVENTION

It is an object of the present invention to be overcome the abovementioned problems observed in conventional zinc oxide varistor materials by providing a varistor material which has an elevated nonlinear index ($\alpha$)and a simple structure and which can be readily produced.

According to the present invention, a varistor material which substantially comprises a crystalline phase of zinc oxide, namely, as the main component, together with that of zinc manganate ($ZnMn_2O_4$) is provided.

DETAILED DESCRIPTION OF THE INVENTION

The varistor material of the present invention may be produced by adding a manganese compound to zinc oxide, calcining the obtained mixture at 1100° to 1350° C. and thermally treating the calcined product again at a temperature higher than 1000° C. and lower than the above calcination temperature. In the above process, any manganese compound may be used so long as it can be converted into manganese oxide by calcining. Examples thereof include inorganic acid manganese salts such as manganese nitrate and halides, organic acid salts such as manganese acetate, propionate, benzoate, acetylacetate, n-butyrate, 4-cyclohexylbutyrate, naphthenate, or 2-ethylhexane and manganese hydroxide. The use of manganese nitrate is preferred.

In order to produce the varistor material according to the present invention in a preferable manner, the manganese compound dissolved in a solvent is added to zinc oxide. This mixing may be conducted by, for example, mixing a solution of the manganese compound with zinc oxide in the presence of a solvent in which the manganese compound is soluble. Examples of the solvent include water, organic solvents and mixtures thereof. Examples of the organic solvents include alcohols such as methanol and ethanol. Any solvent may be used therefor so long as it exerts no direct effect on the zinc oxide and can be readily removed by evaporation after the completion of the mixing. Since the manganese compound is mixed with the zinc oxide in a dissolved form upon this mixing, the manganese compound can be homogeneously carried by zinc oxide particles at a molecular level.

The mixture thus obtained is dried and the solvent is removed by evaporation. Then it is sintered and the sintered product is subsequently heated again (annealing). The sintering is to be conducted at such temperature as to give a sintering density of the sintered product of at least 90% based on the theoretical density of the zinc oxide. Generally, it is conducted at 1100° to 1350° C., preferably 1200° to 1300° C., for 0.5 to 2 hours. The annealing is to be conducted at a temperature lower than the sintering temperature by at least 50° C. and higher than 1000° C., in order to allow the formation of two crystalline phases of zinc oxide (ZnO) and zinc manganate ($ZnMn_2O_4$). Namely, the heating temperature may range from 1000° to 1300° C., preferably 1000° to 1200° C. In a preferred embodiment of the present invention, the sintering is conducted at approximately 1300° C., while the annealing is conducted at approximately 1100° C. The annealing time is 0.5 to 3 hours. When the annealing time is less than 0.5 hour, a remarkable effect cannot be obtained. When the annealing time is over 3 hours, there are no advantage points.

In the present invention, the mixing of zinc oxide with a manganese compound may be preferably conducted by maintaining the manganese compound in a disolved state by using a solvent, as described above. It is needless to say, however, either soluble or insoluble manganese compounds may be mixed with zinc oxide by a physical or mechanical procedure conventionally employed in the art.

In the process of the present invention, the manganese compound may be added to the zinc oxide in an amount of 3 to 7% by mol, preferably 4 to 6% by mol, on a molar basis of MnO, per 100% by mol of ZnO +MnO. When the ratio of the manganese compound does not fall within this range, it becomes difficult to obtain the desired elevated nonlinear index ($\alpha$).

As described above, a practically available varistor material may be made by the process of the present invention by utilizing a manganese compound alone as an additive to be added to zinc oxide.

According to the present invention, a varistor material can be readily produced by adding only one additive (manganese) to zinc oxide. In addition, the varistor material obtained thereby has a sufficiently high nonlinear index ($\alpha$) from a practical viewpoint.

To further illustrate the present invention, the following non-limiting example will be given.

EXAMPLE

A definite amount of manganese nitrate ($Mn(NO_3)_2 \cdot 6H_2O$) was added to zinc oxide in ethanol. After thoroughly mixing, the solvent was removed by evaporation. Then the residue was calcined at 700° C. for 1 hour.

Next, the calcined sample was preliminarily molded into a disc (diameter: 10 mm, thickness: 2 mm) under 300 kg/cm$^2$ followed by pressing under an hydrostatic pressure of 1 t/cm$^2$. The molded material thus obtained was placed in an electric resistance heating oven made of silicon carbide and heated in the atmosphere at a rate of 6 ° C./min. When the temperature reached 1300° C., the material was sintered by maintaining at this temperature for 1 hour. Then it was allowed to cool in the oven. Some portion of this unannealed sintered material was taken and both surfaces of the same were smoothed. Subsequently, an indium/mercury amalgam was applied thereon to thereby give electrodes. Then the electric current/voltage properties thereof were determined by the DC two-terminal method. As a result, samples containing 3 to 7% by mol (referring to MnO +ZnO to 100% by mol, the same will apply hereinafter) of the manganese compound showed remarkable varistor properties.

Table 1 shows the results.

TABLE 1

| MnO (% by mol) | Nonlinear index ($\alpha$) |
|---|---|
| 1 | 2.1 |
| 3 | 4.0 |
| 5 | 6.1 |
| 7 | 4.5 |
| 10 | 2.0 |

When sintered at 1100° to 1350° C., samples containing 3 to 7% by mol of MnO gave dense sintered materials having a sintering density of 90% or above based on the theoretical density of zinc oxide. However, those sintered at a temperature lower than 1100° C. showed a sintering density lower than 90%, while those sintered at a temperature exceeding 1350° C. likewise showed a lowered sintering density. Next, the residual sintered materials were annealed at 1100° C. for an hour (temperature elevation rate: 6° C./min, atmospheric). The current/voltage properties of the obtained samples were determined in the same manner as the one described above. As a result, those containing 3 to 7% by mol of MnO each showed a nonlinear index ($\alpha$) elevated by 10 or more. For example, it was confirmed that a varistor material having a specific resistance of $1.31 \times 10^7$ Ω·cm, a nonlinear index ($\alpha$) of 18.4 and a varistor voltage of 280 V/mm was obtained from that having a specific resistance of $4.09 \times 10^6$ Ω·cm, a nonlinear index ($\alpha$) of 6.1 and a varistor voltage of 320 V/mm. X-ray diffractometry of the powdery annealed sample indicated that it substantially comprised two crystalline phases of ZnO and $ZnMn_2O_4$. These two crystalline phase appeared within a firing temperature range of 1000° to 1300° C.

While the invention has been described in detail and with reference to specific embodiments thereof, it will be apparent to one skilled in the art that various changes and modifications can be made therein without departing from the spirit and scope thereof.

What is claimed is:

1. A varistor material comprising two crystalline phases of ZnO and $ZnMn_2O_4$, wherein Zn and Mn are present at such a ratio that 3 to 7% by mol of MnO is contained per 100% by mol of ZnO +MnO and the nonlinear index ($\alpha$) of the varistor properties is at least 10.

2. A process for production of a varistor material as set forth in claim 1, which comprises adding a manganese compound to ZnO at such a ratio as to give a content of MnO of 3 to 7% by mol based on 100% by mol of ZnO +MnO; sintering the mixture at 1100° to 1350° C.; and further annealing the obtained sintered material at a temperature lower than the sintering temperature by at least 50° C. and higher than 1000° C.

* * * * *